US007786383B2

(12) United States Patent
Gumley

(10) Patent No.: US 7,786,383 B2
(45) **Date of Patent: *Aug. 31, 2010**

(54) ELECTRICAL WIRE CONNECTOR WITH TEMPORARY GRIP

(76) Inventor: Markus Gumley, 8619 Semiahmoo Dr., Blaine, WA (US) 98230

( * ) Notice: Subject to any disclaimer, the term of this patent is extended or adjusted under 35 U.S.C. 154(b) by 0 days.

This patent is subject to a terminal disclaimer.

(21) Appl. No.: 12/121,388

(22) Filed: May 15, 2008

(65) Prior Publication Data

US 2008/0217055 A1 Sep. 11, 2008

Related U.S. Application Data

(63) Continuation-in-part of application No. 11/493,626, filed on Jul. 27, 2006, now Pat. No. 7,394,022.

(51) Int. Cl.
*H01R 4/18* (2006.01)

(52) U.S. Cl. ..... 174/84 C; 174/88 R

(58) Field of Classification Search ..... 174/84 C, 174/88 R

See application file for complete search history.

(56) References Cited

U.S. PATENT DOCUMENTS 1,886,086 A * 11/1932 Damon ..... 403/185
2,674,647 A 4/1954 Dibner
2,802,257 A 8/1957 Holtzapple
3,110,755 A 11/1963 Esser
3,281,524 A 10/1966 Lynch, Jr. et al.
3,538,240 A 11/1970 Sherlock
3,732,528 A 5/1973 Vetter
3,810,078 A * 5/1974 Chordas ..... 439/724
4,801,277 A 1/1989 Seilhan
5,114,359 A 5/1992 Chishima et al.
5,211,570 A 5/1993 Bitney
5,422,438 A 6/1995 Lamome
5,480,315 A 1/1996 Martinelli
5,800,195 A 9/1998 Endo et al.
6,010,348 A 1/2000 Alden
6,135,800 A 10/2000 Majors
6,838,620 B2 1/2005 Murakami et al.
6,957,972 B2 10/2005 Starke et al.
7,304,243 B2 * 12/2007 Polidori ..... 174/84 C
2002/0096353 A1 7/2002 Hanazaki et al.

* cited by examiner

*Primary Examiner*—Chau N Nguyen
(74) *Attorney, Agent, or Firm*—Tejpal S. Hansra

(57) ABSTRACT

An electrical connector includes a crimpable tubular body including a receiving portion for receiving a wire conductor via an opening at a longitudinal end of the tubular body. The tubular body provides a permanent electrical connection to the wire conductor only upon at least a portion of the tubular body being crimped. The receiving portion has a tapered shape and inward projections for engaging the wire conductor to provide sufficient frictional force to resist removal of the wire conductor from the receiving portion prior to crimping, without providing a permanent electrical connection between the tubular body and the wire conductor. In one implementation, the electrical connector is a butt connector with two such equally sized receiving portions for splicing together two wires. In another implementation, the electrical connector is a butt connector with two different sized receiving portions for splicing together two differently sized wires.

47 Claims, 5 Drawing Sheets

ELECTRICAL WIRE CONNECTOR WITH TEMPORARY GRIP

RELATED APPLICATIONS

This application is a Continuation in Part of application Ser. No. 11/493,626 filed on Jul. 27, 2006, the disclosure of which is incorporated herein by reference in its entirety.

FIELD OF THE INVENTION

The present invention relates to a connector for attaching a conductor of a wire to another conductor of another wire (e.g., a power supply wire to an electrical device). More particularly, the connector is a butt connector that receives and temporarily holds an electrical conductor in place within the connector in order to more easily and manageably crimp the connector onto the conductor to form a permanent connection.

BACKGROUND

In many environments, it is often necessary to splice two wires from electrical or electronic components together. For example, splices may be required when one or more wires are broken and must be reconnected or when an electrical component is being replaced with a different component. A butt connector is typically used in line with two wires to splice the wires together. Splicing wires can be performed in a few steps. The butt connector is generally configured as an elongated tube with two ends that respectively receive the two wires to be connected. After crimping the butt connector to the two wires, the two wires become permanently spliced together. In some environments, performing these steps can be difficult. A number of common work site situations can further complicate such splicing operations. For example, on a moving marine vessel, it can be difficult to keep wires in a desired position, and tight spaces often make it difficult to reach wires with both hands or make movements awkward. A person securing the wire(s) to the connector must simultaneously control the position of the wire ends, accurately position the wire ends within the connector, and manipulate a crimping tool around the electrical connector to complete the connection.

Simultaneously coordinating the end positions of two wires, a butt connector, and a crimping tool can be challenging, particularly in tight spaces. Furthermore, because wires are generally considered to be unsightly, they are frequently located in hard to reach locations resulting in limited access to already difficult to handle wiring. For example, motorized equipment and vehicles, such as automobiles and boats, may require splicing of wires that are situated in tight, hard-to-reach places where manipulating of wires, connectors, and tools is problematic.

There is therefore a long felt need for an electrical connector that includes features which enable a splice or connection to be more easily performed even in the above-mentioned adverse situations. More specifically, an electrical connector is needed that allows wires to be more easily positioned in the connector even when the wires are unwieldy and even when the splicing must be performed in a limited access situation.

SUMMARY

Generally, the present invention relates to an electrical connector for connecting a conductor of a wire to another conductor or to an electrical device. In one embodiment, the electrical connector includes an elongated body member having a center and opposite terminal ends and includes an opening, tapered cavity or receiving portion in each terminal end. The openings are tapered and the surface of the openings includes ridges thereon that may be formed as female threading. The openings, therefore, have threading that tapers with the surface of the openings. The openings are tapered from a larger diameter at the terminal end to a smaller diameter toward the center of the elongated body member.

In a first embodiment, the electrical connector includes first and second oppositely extending terminal ends. In this first, double-ended embodiment, the tapered threading in the first end is threaded in an opposite direction from the tapered threading in the second end (e.g., one cavity has right-handed threading and the other cavity has left-handed threading). As a result of this opposite direction threading, when conductors are wedged into respective first and second terminal ends of the electrical connector, the threading engagement between the conductors and their respective tapered threads can be advanced by rotating the connector about its longitudinal axis in one direction. In other words, the opposite threading configuration enables a user to tighten both conductors to the connector by rotating the connector in one direction. Tightening the connection between the connector and conductors also has the effect of pulling the ends of the conductors toward the center of the connector. Therefore, rotating the connector to increase the connection strength between the connector and the conductors provides an even more secure temporary grip than the initial wedging grip strength achieved between the conductors and the connector upon initial insertion of the conductors into the connector's openings.

The present invention allows a conductor of a wire to be easily, electrically connected to another wire or to another electrical component in a variety of challenging environments by following a few easy steps. To make the connection, the wires are first prepared by stripping the ends of their external insulation from the exterior of their inner conductors. Each wire's conductor is then inserted into one of the respective openings in the terminal ends of the electrical connector so that the conductors of the wires enter the openings and engage the ridges on the surfaces of the tapered openings. The insertion of the conductors into the tapered openings causes each conductor to be wedged in its respective tapered opening such that the surface of the opening and resists removal of the conductor from the tapered opening. This initial wedging grip strength is sufficient to temporarily hold the conductors within the connector in a hands free manner.

To complete the temporary connection, the opposite direction tapered threading comes into play. As mentioned above, the tapered threading in the first end is threaded in an opposite direction from the tapered threading in the second end. As a result of this opposite direction threading, a user turns the conductor in a single direction about the longitudinal axis to advance the engagement between the conductors and their respective tapered threads. Advancing the engagement provides an additional temporary gripping force between the connector and wire conductors over and above the initial griping strength provided by simply inserting the conductors into the connector until they become wedged.

The resisting frictional wedging forces hold the wire conductors in place in their respective tapered openings until a user applies a force to the external surface of the electrical connector with a crimping tool to more permanently secure the wedged conductors. In other words, the frictional resistive force provided between the conductors of the wire and the tapered opening prevents the conductors from being dislodged until a more permanent connective force is supplied by crimping. The crimping of the electrical connector provides the final connection between the wires and the electrical connector and thus the wires themselves. In the crimped state, the ridges or threading provide additional gripping that makes the permanent connection more rugged than conventionally the gripping of conventional connectors.

The temporary wedging or gripping force of the tapered ridges resists removal of the conductors from the tapered opening and simplifies the process of coupling wires via crimping by preventing wires from becoming dislodged from the connector prior to crimping. For example, in the case of reconnecting two broken conductors, a user need only wedge the first wire conductor into the tapered opening (which temporarily holds itself thereafter), wedge the second wire conductor in the second tapered opening (which will also hold itself temporarily thereafter), then (with one hand) crimp the ends of the electrical connector permanently onto the wire conductors. Optionally, after wedging the two wires and before crimping, a user may rotate the connector to further engage the conductors onto the tapered threading for a more secure temporary grip. In other words, in some situations, a user may not find it necessary to apply the additional temporary grip gained by rotating the connector to tighten the reverse threading onto the conductors. The user may determine in a particular situation, that sufficient temporary connection force has already been achieved by the initial insertion wedging of the conductors into the openings, making it unnecessary to perform the conductor rotation step to increase the connection force.

Because the material of the electrical connector is electrically conductive, a non-conductive insulating sheath is provided around the electrical connector. The insulation sheath generally conforms to the outer profile of the conductor. However, the insulation sheath need not conform exactly as long as the sheath makes sufficient contact with the conductor's outer surface to secure the sheath to the conductor. The insulating sheath can extend past the terminal ends of the electrical connector. Optionally, when a wire is inserted into the tapered opening, the conductor portion of the wire may enter the tapered opening and engage the inner surface of the tapered opening. At the same time, the wire insulation sheath portion of the wire may enter and internally overlap the portion of the insulating sheath that extends past the terminal end of the electrical connector. Overlapping of the insulators maximizes the possibility that electrical flow through the spliced wires and electrical connector will be confined within the insulation of the wire and within the insulating sheath placed over the electrical connector.

BRIEF DESCRIPTION OF THE DRAWINGS

Like reference numerals have been used to identify like elements throughout this disclosure.

DETAILED DESCRIPTION

Figure 1:
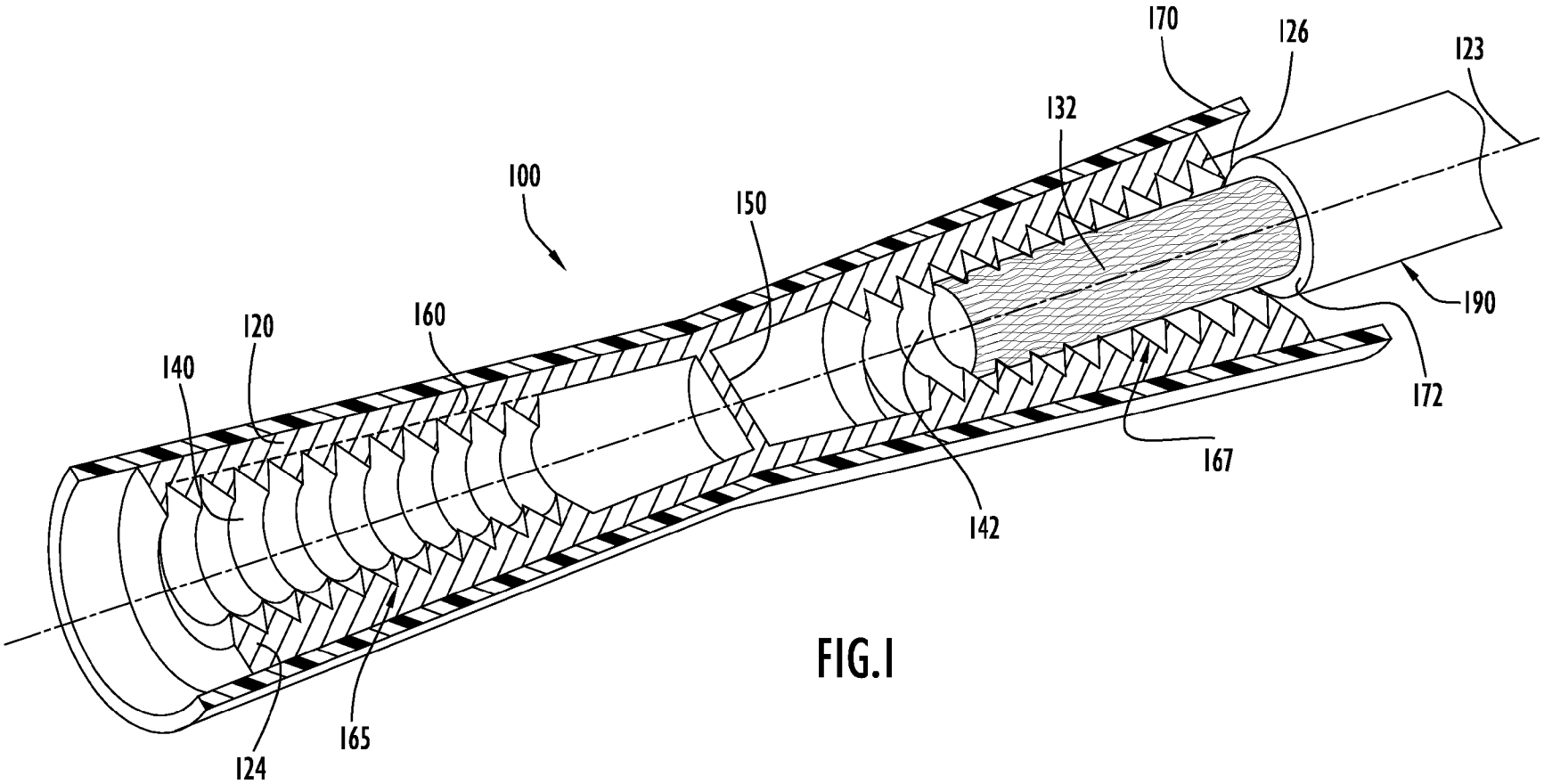
FIG. 1 illustrates a perspective cut-away view of a butt (splice) connector with tapered, ridged terminals receiving a wire conductor according to an exemplary first embodiment of the invention.

Exemplary embodiments of the wire connector of the present invention will now be described in detail. The features of the wire connector will be discussed with reference to FIGS. 1-5. The figures are drawn to illustrate various aspects of the invention, and it will be appreciated that the features shown in the drawings are not necessarily to scale. For example, the figures are drawn to accentuate the tapered shape of the connector openings and the ridge structures therein to illustrate how these features facilitate a frictional engagement between wire conductors and the connector.

FIG. 1 illustrates a perspective cut-away view of a butt (or "splice") connector 100 according to a first exemplary embodiment of the present invention. Connector 100 comprises an electrical connector 120 and an insulating sheath 170 that surrounds the electrical connector 120. The electrical connector 120 comprises a generally bow tie or butterfly-shaped tubular, elongated conductive member including longitudinal terminal ends 124, 126. While shown in the figures with a substantially butterfly-shape, in general, the connector of the present invention can have virtually any cross sectional shape (e.g., cylindrical (round), rectangular, star shaped, etc.). Each terminal end 124, 126 includes a tapered cavity (or "receiving portion") 140, 142, designed to receive and retain wire conductors. The processes of receiving wire conductors is discussed in greater detail below.

The receiving portions 140, 142 are tapered to be larger toward the terminals ends 124, 126 and smaller toward the center of the electrical connector 120 near a central stop 150. The stop 150 is the portion of the electrical connector 120 located between the tapered receiving portions 140, 142 toward the center of the electrical connector 120 against which the conductors butt to limit insertion, in the event the conductors extend to the inward end of the receiving portions 140, 142. The stop 150 may be a continuous, solid boundary, as shown in the figures, or may be an opening partially blocked by protrusions that extend radially inward. The latter implementation may facilitate easier crimping of the connector 100 in the case where the entire connector is crushed in the crimping process (as opposed to only the ends of the connector). The connector may also exclude a stop 150 all together and, instead, have a through opening between the receiving portions 140, 142.

The exterior of the electrical connector 120 can accommodate a connector insulating sheath 170 for safely containing current passing through the electrical connector 120. The connector insulating sheath 170 is shown closely fitting the outer profile of the electrical connector 120. However, a cylindrical sheathing may be used which contacts the electrical connector 120 only toward the terminal ends 124, 126 of the electrical connector 120. As shown in FIGS. 1-5, the connector insulating sheath 170 extends beyond the terminal ends 124, 126 of the electrical connector 120 to ensure overlap with the wire insulating sheath 172 of the wire to be secured. Thus, the electrical connector 120 and the connector insulating sheath 170 constitute the butt connector 100.

Figure 2:
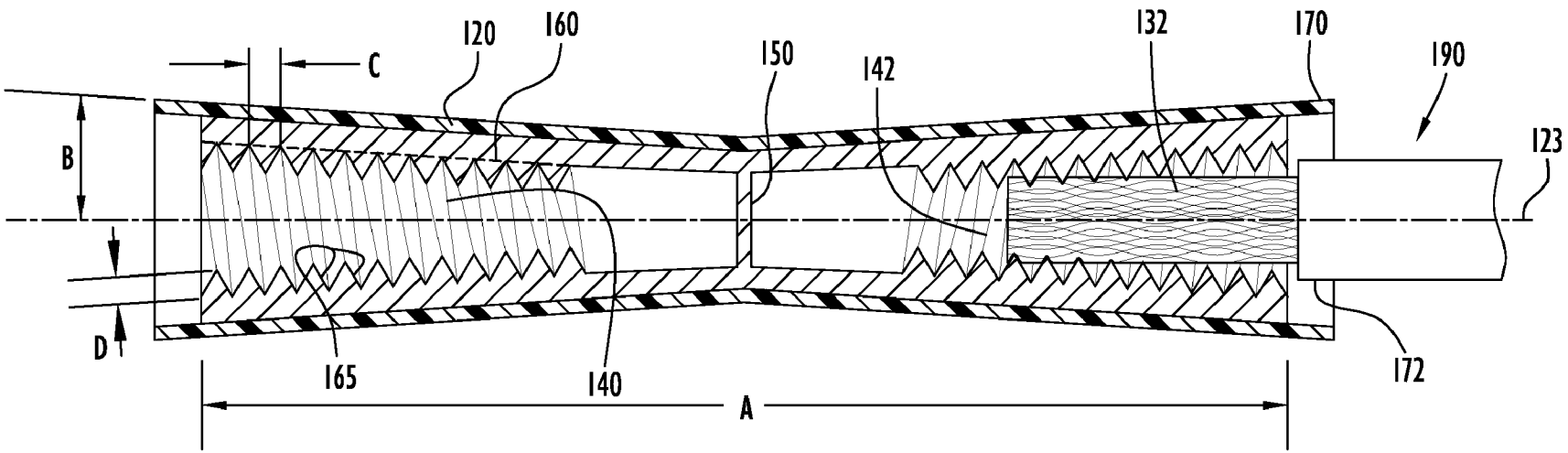
FIG. 2 illustrates a cross sectional view in elevation of the butt connector of the first embodiment with a wire inserted into the insulating sheath surrounding the electrical connector.

FIG. 2 illustrates a cross sectional view in elevation of the electrical connector 120 of the first embodiment within the connector insulating sheath 170. As discussed above, the electrical connector 120 includes tapered receiving portions 140, 142. The tapered receiving portions 140, 142 have a funnel or cone shaped interior surface 160 with a decreasing inner diameter as the openings extend toward the center of the connector. The funnel shape of the interior surface 160 is shown in FIG. 2 as a dashed line. The interior surface will be discussed in greater detail below. The interior surface 160 can have walls that extend along straight lines that define a linear relationship in the reduction of size of the tapered receiving portions 140, 142 as the cavity extends in a direction from the terminal ends 124, 126 to a location proximate the center of the electrical connector 120 near the stop 150. The linear reductions ensure that a conductor can be easily inserted into the relatively large opening at the terminal end 124, 126, while at the same time ensuring that conductors of varying sizes will quickly be wedged in a narrowing, relatively smaller tapered aperture within the receiving portion 140, 142. It will be appreciated, however, that the invention is not limited to a linear taper configuration.

The interior surface 160 further include ridges 165 thereon. FIGS. 1 and 2 illustrate the interior surface 160 as a dotted line. The ridges 165 extend from the inner surface 160 toward the longitudinal central axis 123 of the electrical connector 120. The ridges 165 may be in the form of spiral or helical threading on the interior surface 160, although the ridges 165 need not have a spiral form. For example, the ridges can include a series of unconnected rings that protrude inward into the cavity or a series of spaced-apart inward projections. More generally, the ridges 165 can have any configuration of inward projections or of an undulating surface that provides surfaces capable of ensnaring strands of a wire conductor or providing a significant frictional force for preventing the wire conductor from easily slipping out of the opening once engaged with the ridges 165.

Moreover, FIG. 2 defines several dimensional parameters that contribute to the effective functioning of the connector 100 of the present invention. The connector length A, which is the longitudinal length of electrical conductor 120 from terminal end 124 to terminal end 126, can be in a range between about 0.5" to about 2.5", optionally about 1.0". The taper angle B, which is defined as the slope of the interior surface 160 relative to the longitudinal central axis 123, can be in a range between about 2° to about 15°, optionally about 5°. The thread coarseness (or "threads per inch") C, which is defined as the number of ridge threads 165 encountered along an inch of conductor length A, can be in a range between about 20 to about 40 threads per inch, optionally about 28 threads per inch. Thread depth (or "root diameter thread") D, which is defined as the distance from the interior surface 160 to a peak/apex of an average ridge 165, can be in a range between about 0.015" to about 0.06", optionally about 0.03".

The above dimensional parameters have been found to improve the effectiveness of the connector 100 of the present invention, providing excellent temporary gripping of multi-stranded wires. In particular, when chosen in the ranges indicated above, parameters A, B, C and D allow the receiving portions to perform effectively both to develop a sufficient temporary removal resisting wedge force and a sufficient added resistance force when the connector is rotated to further engage the conductor to the spiral threads of the receiving portions. Unlike the present invention, which is dimensioned to receive variously sized multi-stranded single conductors, conventional connectors that include threaded receiving portions are dimensioned to engage multiple wires that have been twisted together. Furthermore, many conventional connectors that operate based on parameters outside of the above ranges, merely take into account a connection by forcing threads onto conductors and do not seek to account for temporary removal resisting wedge forces. While the above ranges of dimensions have been found to be particularly effective, it will be appreciated that the invention is not limited to devices having these dimensions, and one or more of the aforementioned dimensions of the connector may fall outside these ranges.

FIG. 2 illustrates a cross sectional view of the butt connector 100 of the first embodiment of the present invention with wire 190 inserted into the end of the connector insulating sheath 170. Wire 190 comprises a stranded copper conductor 132 lined on its external surface with an external insulation 172. FIG. 2 also shows the wire insulation sheath 172 inserted into the connector insulating sheath 170 and shows the conductor 132 inserted into the connector insulating sheath 170 and into the tapered receiving portion 142. Because the receiving portion is tapered, a range of wire gauge sizes may be effectively accommodated in a single size receiving portion. More specifically, FIG. 2 also shows the conductor 132 inserted into the tapered receiving portion 142 to the point where the inner diameter of the tapered receiving portion 142 comes into firm contact with the outer diameter of the strands of conductor 132. The firm connection between the conductor 132 and the receiving portion 142 is provided by a frictional and mechanical interaction between strands of the conductor 132 and the inner surface 160 of receiving portion 142, as the conductor 132 is wedged into the tapered receiving portion 142. In the process of inserting the stranded conductor 132 into the receiving portion 142, portions of some of the strands become disfigured and lodged in various ridges 165 of the receiving portion 142. As discussed above, this lodging generates significant mechanical and frictional force that resists removal of the conductor 132 from the receiving portion 142. In particular, when the tapered receiving portion 142 includes ridges 165 such as spiral threading, the ridges provide additional frictional force or gripping action between the conductor 132 and the electrical connector 120.

Figure 3:
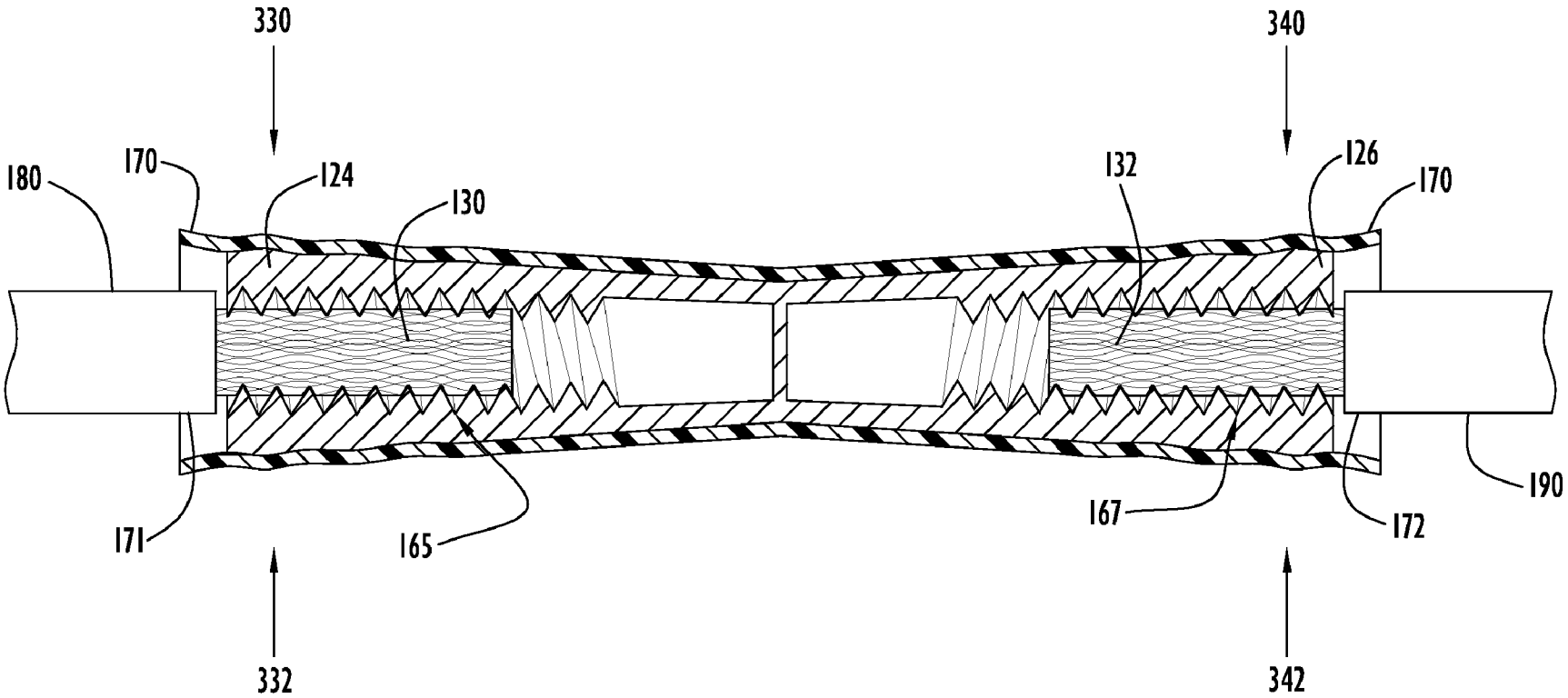
FIG. 3 illustrates a cross sectional view of the butt connector of the first embodiment with the electrical connector crimped permanently around two conductors.

Moreover, FIG. 3 shows that the threading/ridges 165 of receiving portion 140 are right-hand threaded and the threading/ridges 167 of the receiving portion 142 are left-hand threaded. Inherently, if a generally tubular object is rotated about its longitudinal axis, this rotation will appear as a clockwise rotation as view from one longitudinal end and, simultaneously, as a counterclockwise rotation as view from the other longitudinal end. In order to further secure the conductor 130 onto the receiving portion 140, the conductor 130 must be turned clockwise relative to the receiving portion 140. However, while receiving portion 140 is rotating clockwise, the other receiving portion is rotating counterclockwise. Thus, if both receiving portions 140 and 142 were similarly threaded (e.g., both right-hand threaded), performing the rotation to tighten the coupling between conductor 130 and receiving portion 140 would simultaneously loosen any connection between conductor 132 and receiving portion 142. To facilitate a tightening of both connections at once, the threads/ridges 167 of receiving portion 142 are left-hand threaded (opposite of receiving portion 140). As a result, rotating the connector 100 about central longitudinal axis 123 in one direction will simultaneously tighten the grip on both conductors 130, 132, and rotating the connector 100 about the central longitudinal axis 123 in the other direction will simultaneously loosen the grip on both conductors 130, 132. Therefore, after the conductors 130, 132 have been temporarily secured by insertion (wedging) into their respective receiving portions 140, 142, both connections can be further secured by rotating the connector 100. As a result, the strength of both connections is increased to further assure and properly position the conductors 130, 132 in the receiving portions 140, 142 before crimping is performed.

As discussed above, the insulating sheathing 170 of the splice connector 100 extends past the end of the electrical connector 120. When the wires 180 and 190 are inserted into the extending ends of the insulating sheath 170, external insulation 171, 172 enters the insulating sheath 170. The insulating sheath 170 overlaps the external insulation 171, 172 to minimize the possibility of exposure to external elements or any leakage of current from butt connector 100.

As shown in FIG. 3, after either of wires 180, 190 are properly inserted into the butt connector 100 such that the conductors 130, 132 are temporarily wedged in the tapered receiving portions 140, 142, the conductors can be permanently connected to the electrical connector 120. Permanent connection of the conductors 130, 132 to the electrical connector 120 is achieved by crimping at least the terminal ends 124, 126 of the electrical connector 120 onto the inserted conductor 130, 132. The crimped state of the electrical conductor 120 is depicted in FIG. 3 via the irregular surface and cross-sectional lines, suggesting that the electrical conductor 120 and the sheathing 170 have been deformed by the crimping process. Any crimping tool that can further restrict the inner diameter of the tapered opening around the wedged conductor 130, 132 can be utilized. Furthermore, when the tapered receiving portions 140, 142 include projections as discussed above, the projections enhance the gripping effect of the crimping between the connector 130, 132 and the electrical connector 120.

FIG. 3 shows arrows 330, 332, 340, 342 pointing in the direction of crimping force. The crimping tool can apply crimping force at any point around the circumference of the end of the electrical connector 120 as long as the forces are directed inward toward the axis 123 of conductors 130, 132 to reduce the inner diameter (transverse cross-sectional area) of at least a portion of the receiving portions 140, 142. Optionally, a crimping force can be applied that crushes or collapses the entire connector, rather than just the end portions. In this case, it may be advantageous to configure the center stop 150 as a non-solid member, e.g., as inward projections that block passage of the inserted wires. Thus, the tubular body of the connector 120 provides a permanent electrical connection with the wire conductors 130, 132 only upon at least a portion of the tubular body being crimped, and the tapered shape and inward projections of the receiving portions 140, 142 provide a sufficient frictional force to resist removal of the wire conductors 130, 132 from the receiving portions 140, 142 prior to crimping, without providing a permanent electrical connection between the tubular body and the wire conductors 130, 132 (i.e., a temporary connection). As used herein, a permanent electrical connection refers to a connection that cannot be broken by a modest force applied by hand to the wiring and that typically meets applicable electrical code requirements for electrical wiring of structures, vehicles, etc. This is to be contrasted with a temporary connection (pre-crimping) that is sufficient to prevent slippage of the connector from the wire (s) due merely to gravity or movement of the wires but that would not withstand a substantial external force such as firm tugging on the wires and would not typically meet electrical code requirements.

In another scenario (not shown), if the diameter of the external insulation 171, 172 are smaller than the diameter of the tapered receiving portions 140, 142 toward the ends of the electrical conductor 120 (which has the larger diameter), the entire wire 180, 190, including the wire insulation sheaths 171, 172 will be insertable into the tapered receiving portions 140, 142. In this case, temporary wedge force may be provided between the conductors 130, 132 and the tapered receiving portions 140, 142 and/or between the wire insulation sheaths 171, 172 and the tapered receiving portions 140, 142. Also in this case, when crimping takes place, the terminal ends 124, 126 may be collapsed over the conductor 130, 132 and the wire insulation sheaths 171, 172 as long as there is a firm connection between the conductors 130, 132 and the electrical connector 120.

Figure 4:
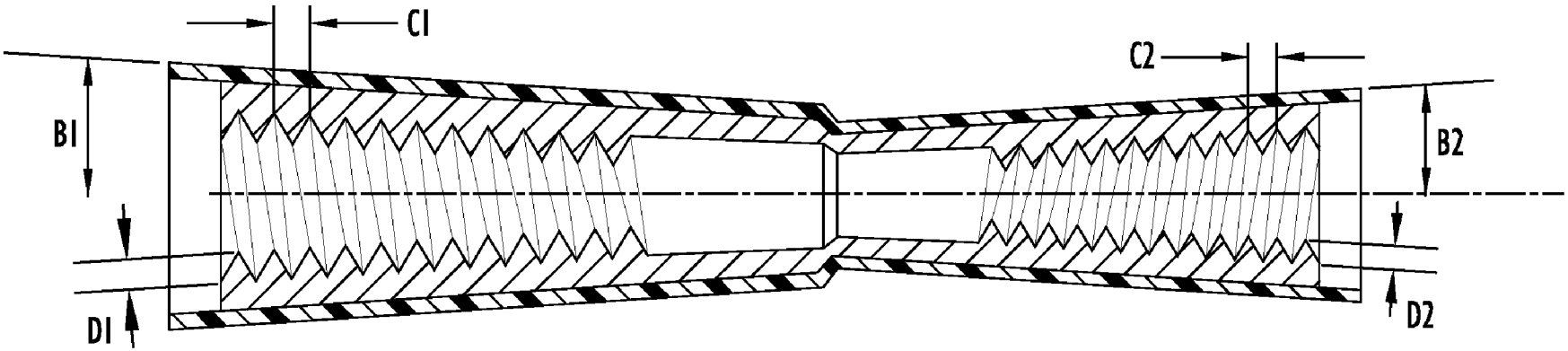
FIG. 4 illustrates a cross sectional view of a second embodiment of the butt connector of the present invention showing differently sized connector receiving portions.

FIG. 4 illustrates a cross sectional view of a second embodiment of the electrical connector 120 of the present invention showing one receiving portion 140 proportionally larger than the opposite receiving portion 142. It is sometimes useful to be able to connect or splice two wire ends that are of different size. For example, a user may desire to splice a 10 gauge wire to a smaller 12 gauge wire. The effectiveness of the receiving portion in receiving a wire conductor as described above can best be achieved within the range of wire connector lengths A as described above. In other words, using dimensions of the parameters discussed above, the size of the connector's receiving portions may be enlarged or reduced proportionally without loss of effectiveness.

As suggested above, the connector 120 may be designed by choosing parameters A, B, C and D for one receiving portion and simply enlarging or reducing the other receiving portion proportionally. On the other hand, the size relationship between receiving portion 140 and receiving portion 142 may be determined completely independently. Parameters A, B, C and D may be chosen for one receiving portion and an independent set of parameters A, B, C and D may be chosen for the other receiving portion.

As discussed above, FIG. 4 illustrates a wire connector 120 in which the receiving portion 140 is proportionally enlarged relative to the receiving portion 142. The difference in size between these two receiving portions 140, 142 enables a user to insert wire conductors of one size range into receiving portion 140 and to insert wire conductors of a smaller size range into receiving portion 142. This variable size connector provides a user with significant flexibility when faced with splicing wires of varying sizes. As long as the receiving portions 140, 142 are appropriately sized to receive a particular size wire end, the connector will enable the user take advantage of the temporary grip advantages of the present invention despite the differently sized wiring. In other words, parameters B1, C1, D1 can be respectively different from parameters B2, C2, D2.

The insulating sheath 170 can be made from any electrically insulating material or any combination of electrically insulating materials (e.g., plastics, rubbers, etc.). In addition, the electrical connector 120 can be made from any electrically conductive material or any combination of electrically conductive materials (e.g., copper, tin, brass, iron, steel, etc.). Furthermore, the conductor can be made in any of the conventional connector sizes and proportions. By way of non-limiting example, the overall length of the insulating sheath 170 can be approximately 1.25 inch long, and the electrical connector 120 can be approximately 1.0 inch long, resulting in an overlap on each end of about ⅛ of an inch. The central stop 150 can be about 1/16 of an inch thick, such that cavities 140, 142 are slightly less than ⅜ of an inch in length. The inner diameter or inner circumference of receiving portions 140, 142 can be sized to work with wires of a particular gauge, e.g., 14 gauge wire, or a range of gauges. In general, the invention is not limited to any particular dimensions, and any dimensions suitable for a particular application are considered to fall within the scope of the invention.

Figure 5:
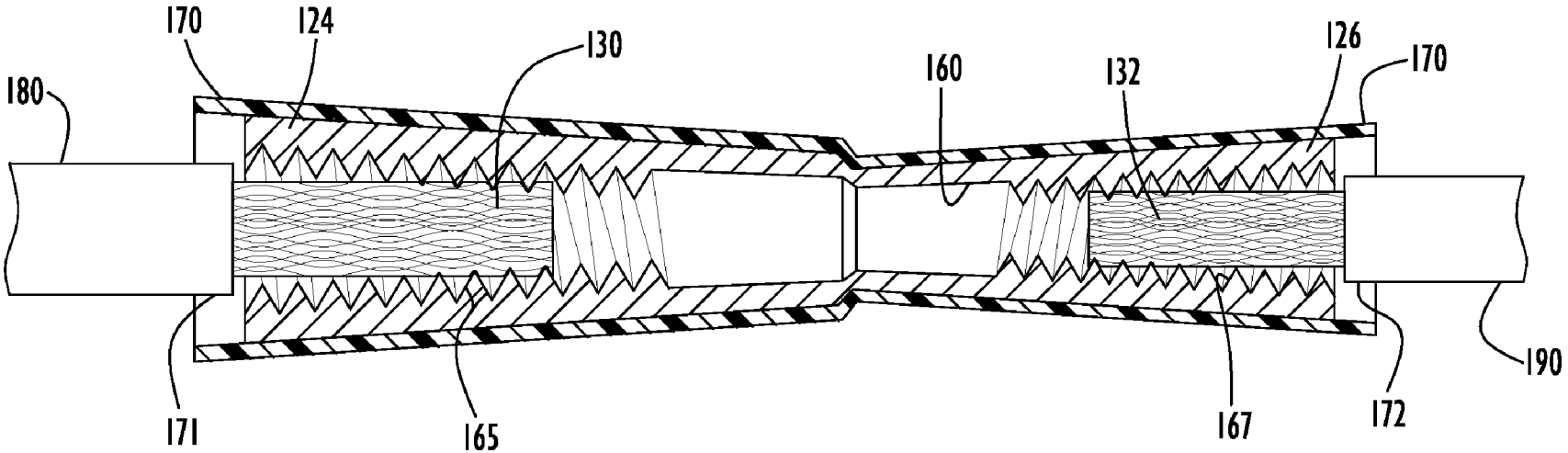
FIG. 5 illustrates the cross sectional view of FIG. 4 further showing differently sized conductors received in the differently sized receiving portions.

FIG. 5 illustrates the cross sectional view of FIG. 4 further showing differently sized conductors 130, 132 received in the differently sized receiving portions 140, 142. The operation of inserting the conductors into their respective receiving portions to generate a temporary grip and the operation of rotating the connector to further engage the spiral threading with the conductor are the same as in the case of the similarly sized receiving portions. Furthermore, the crimping process is the same. Therefore, despite the variable size receiving portions of the connectors of the second embodiment, all of the same advantages enjoyed by the uniformly sized connectors of the first embodiment are also available.

It is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

Having described preferred embodiments of new and improved electrical wire connector, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. An electrical connector, comprising:

a crimpable tubular body including: a first receiving portion for receiving a first wire conductor via a first opening at a first longitudinal end of the tubular body; and a second receiving portion for receiving a second wire conductor via a second opening at a second longitudinal end of the tubular body, the tubular body providing a permanent electrical connection to the first and second wire conductors only upon at least a portion of the tubular body being crimped;

wherein the first and second receiving portions each include a tapered shape with a transverse cross-sectional area that diminishes inward of their respective first and second longitudinal ends, the first and second receiving portions including inward projections along the tapered portion for engaging the first and second wire conductors, the tapered shape and inward projections providing a sufficient frictional force to resist removal of the first and second wire conductors from the first and second receiving portions prior to crimping, without providing a permanent electrical connection between the tubular body and the first and second wire conductors;

wherein the first receiving portion is larger than the second receiving portion.

2. The electrical connector of claim 1, wherein the inward projections comprise ridges.

3. The electrical connector of claim 1, wherein the inward projections comprise threading.

4. The electrical connector of claim 3, wherein the threading in the first receiving portion is right-hand threaded and the threading in the second receiving portion is left-handed threaded.

5. The electrical connector of claim 3, wherein a thread coarseness of the threading is between about 20 threads per inch to about 40 threads per inch.

6. The electrical connector of claim 3, wherein a thread depth of the threading is between about 0.015 inches to about 0.06 inches.

7. The electrical connector of claim 1, wherein a distance between the first longitudinal end and the second longitudinal end is between about 0.5 to about 2.5 inches.

8. The electrical connector of claim 1, wherein a taper angle of the first and second receiving portions is between about 2° to about 15°.

9. The electrical connector of claim 1, further comprising a stop member at an inward end of the first receiving portion for limiting insertion of the first wire conductor into the tubular body.

10. The electrical connector of claim 9, wherein the stop is a solid member.

11. The electrical connector of claim 1, wherein the first receiving portion is tapered in a linear manner.

12. The electrical connector of claim 1, further comprising an insulating sheath covering the tubular body.

13. The electrical connector of claim 1, wherein the first and second receiving portions are configured to receive multi-stranded wires.

14. An electrical connector, comprising:

a crimpable body including: a first receiving portion for receiving a first wire conductor via a first opening at a first longitudinal end of the body; and a second receiving portion for receiving a second wire conductor via a second opening at a second longitudinal end of the body, the body providing a permanent electrical connection to the first and second wire conductors only upon at least a portion of the body being crimped;

wherein the first and second receiving portions each include a tapered shape with a transverse cross-sectional area that diminishes inward of their respective first and second longitudinal ends, the first and second receiving portions including inward projections along the tapered portion for engaging the first and second wire conductors, the tapered shape and inward projections providing a sufficient frictional force to resist removal of the first and second wire conductors from the first and second receiving portions prior to crimping, without providing a permanent electrical connection between the body and the first and second wire conductors;

wherein the electrical connector is of unitary construction.

15. The electrical connector of claim 14, wherein the sufficient frictional force is provided in the absence of a spring.

16. The electrical connector of claim 14, wherein the inward projections comprise ridges.

17. The electrical connector of claim 14, wherein the inward projections comprise threading.

18. The electrical connector of claim 17, wherein the threading in the first receiving portion is right-hand threaded and the threading in the second receiving portion is left-handed threaded.

19. The electrical connector of claim 14, wherein a taper angle of the first and second receiving portions is between about 2° to about 15°.

20. The electrical connector of claim 14, further comprising a stop member at an inward end of the first receiving portion for limiting insertion of the first wire conductor into the body.

21. The electrical connector of claim 20, wherein the stop is a solid member.

22. The electrical connector of claim 20, wherein the first opening and the stop are separated by a first distance and wherein the tapered shape of the first receiving portion spans more than half of the first distance.

23. The electrical connector of claim 22, wherein the tapered shape of the first receiving portion spans substantially the first distance.

24. The electrical connector of claim 14, wherein the first receiving portion is tapered in a linear manner.

25. The electrical connector of claim 14, further comprising an insulating sheath covering the body.

26. The electrical connector of claim 14, wherein the first and second receiving portions are configured to receive multi-stranded wires.

27. An electrical connector, comprising:

a crimpable body including: a first receiving portion for receiving a first wire conductor via a first opening at a first longitudinal end of the body; and a second receiving portion for receiving a second wire conductor via a second opening at a second longitudinal end of the body, the body providing a permanent electrical connection to the first and second wire conductors only upon at least a portion of the body being crimped;

wherein the first and second receiving portions each include a tapered shape with a transverse cross-sectional area that diminishes inward of their respective first and second longitudinal ends, the first and second receiving portions including inward projections along the tapered portion for engaging the first and second wire conductors, the tapered shape and inward projections providing a sufficient frictional force to resist removal of the first and second wire conductors from the first and second receiving portions prior to crimping, without providing a permanent electrical connection between the body and the first and second wire conductors;

wherein the inward projections comprise threading, wherein the threading in the first receiving portion is right-hand threaded and not left-hand threaded, and wherein the threading in the second receiving portion is left-hand threaded and not right-hand threaded.

28. The electrical connector of claim 27, wherein the first receiving portion and the second receiving portion are separated by a stop member.

29. The electrical connector of claim 27, wherein the electrical connector is of unitary construction.

30. The electrical connector of claim 27, wherein the sufficient frictional force is provided in the absence of a spring.

31. The electrical connector of claim 27, wherein the body has a longitudinal axis and wherein rotation about the longitudinal axis in a first direction causes the first and second wire conductors to be moved towards one another.

32. The electrical connector of claim 31, wherein rotation about the longitudinal axis in a direction opposite to the first direction causes the first and second wire connectors to be moved away from one another.

33. An electrical connector, comprising:

a crimpable body including: a first receiving portion for receiving a first wire conductor via a first opening at a first longitudinal end of the body; and a second receiving portion for receiving a second wire conductor via a second opening at a second longitudinal end of the body, the body providing a permanent electrical connection to the first and second wire conductors only upon at least a portion of the body being crimped;

wherein the first and second receiving portions each include a tapered shape with a transverse cross-sectional area that diminishes inward of their respective first and second longitudinal ends, the first and second receiving portions including inward projections along the tapered portion for engaging the first and second wire conductors, the tapered shape and inward projections providing a sufficient frictional force to resist removal of the first and second wire conductors from the first and second receiving portions prior to crimping, without providing a permanent electrical connection between the body and the first and second wire conductors.

34. The electrical connector of claim 33, wherein the inward projections comprise ridges.

35. The electrical connector of claim 33, wherein the inward projections comprise threading.

36. The electrical connector of claim 35, wherein the threading in the first receiving portion is right-hand threaded and the threading in the second receiving portion is left-handed threaded.

37. The electrical connector of claim 35, wherein a thread coarseness of the threading is between about 20 threads per inch to about 40 threads per inch.

38. The electrical connector of claim 35, wherein a thread depth of the threading is between about 0.015 inches to about 0.06 inches.

39. The electrical connector of claim 33, wherein a distance between the first longitudinal end and the second longitudinal end is between about 0.5 to about 2.5 inches.

40. The electrical connector of claim 33, wherein a taper angle of the first and second receiving portions is between about 2° to about 15°.

41. The electrical connector of claim 33, further comprising a stop member at an inward end of the first receiving portion for limiting insertion of the first wire conductor into the tubular body.

42. The electrical connector of claim 41, wherein the stop is a solid member.

43. The electrical connector of claim 41, wherein the first opening and the stop are separated by a first distance and wherein the tapered shape of the first receiving portion spans more than half of the first distance.

44. The electrical connector of claim 43, wherein the tapered shape of the first receiving portion spans substantially the first distance.

45. The electrical connector of claim 33, wherein the first receiving portion is tapered in a linear manner.

46. The electrical connector of claim 33, further comprising an insulating sheath covering the tubular body.

47. The electrical connector of claim 33, wherein the first and second receiving portions are configured to receive multi-stranded wires.

* * * * *